US012369656B1

(12) United States Patent
Laporta

(10) Patent No.: US 12,369,656 B1
(45) Date of Patent: Jul. 29, 2025

(54) ILLUMINATED SAFETY GLOVES

(71) Applicant: Anna Laporta, Ladysmith (CA)

(72) Inventor: Anna Laporta, Ladysmith (CA)

( * ) Notice: Subject to any disclaimer, the term of this patent is extended or adjusted under 35 U.S.C. 154(b) by 0 days.

(21) Appl. No.: 18/517,691

(22) Filed: Nov. 22, 2023

(51) Int. Cl.
*A41D 19/015* (2006.01)

(52) U.S. Cl.
CPC ..... *A41D 19/0157* (2013.01)

(58) Field of Classification Search
CPC ..... A41D 19/0157
USPC ..... 450/159
See application file for complete search history.

(56) References Cited

U.S. PATENT DOCUMENTS 6,976,274 B1 * 12/2005 Dufresne ..... A41D 19/01535 2/161.6
7,399,099 B2 * 7/2008 Stokes ..... A41D 19/0157 362/802
D589,678 S 4/2009 Lawrence
7,597,449 B2 10/2009 Stokes
8,230,522 B1 7/2012 Bell
8,540,389 B2 9/2013 Tang
D702,889 S 4/2014 Daniel
8,882,285 B2 11/2014 Walsh
9,148,931 B2 9/2015 Valenti
9,438,743 B1 9/2016 Lee et al.
9,572,384 B2 2/2017 Tiffin
9,839,244 B2 12/2017 Tiffin
10,398,181 B2 9/2019 Tiffin
2008/0007427 A1 * 1/2008 Stokes ..... A41D 19/0157 340/901
2011/0310593 A1 * 12/2011 Lee ..... A41D 19/0157 2/160
2012/0081885 A1 * 4/2012 Schrimmer ..... A41D 19/0157 362/106
2020/0352264 A1 * 11/2020 Fugate ..... A41D 19/0024

* cited by examiner

*Primary Examiner* — Gloria M Hale
(74) *Attorney, Agent, or Firm* — Cramer Patent & Design, PLLC.; Aaron R. Cramer

(57) ABSTRACT

A pair of illuminated safety gloves is a safety and communication tool designed to enhance visibility and convey critical information through dynamic LED-based illumination. The gloves feature surface illumination, independent operation for the right and left hand, and integration with motion sensors for gesture-based control. The gloves find applications in diverse fields such as traffic control, signaling, and safety enforcement, providing a versatile solution to improve safety and communication in various occupational settings.

11 Claims, 5 Drawing Sheets

ILLUMINATED SAFETY GLOVES

RELATED APPLICATIONS

None.

FIELD OF THE DEVICE

The present device relates to safety gloves and more specifically to illuminated safety gloves.

BACKGROUND OF THE DEVICE

The work environments of police officers, firefighters, paramedics, and other emergency response personnel are frequently stressful and potentially hazardous. This can include accident and crime sites, as well as natural disasters and other emergencies. Inadequate illumination compounds the risks they face, as it reduces visibility and increases the likelihood of accidents or misunderstandings.

In emergency response situations, illumination is crucial. It helps these professionals see plainly, accurately assess the situation, and communicate with each other and the general public. Insufficient illumination can hinder their ability to perform their duties safely and effectively.

Multicolored flashlights are versatile instruments that can be utilized in a variety of emergency response scenarios. They can be utilized for signaling, directing traffic, marking areas, and providing various types of illumination as required. The challenge, however, is that traditional flashlights require one hand to hold, limiting the user's ability to simultaneously perform other essential duties.

Due to the complexity of their responsibilities, emergency personnel require hands-free illumination solutions. This would enable them to use both hands for duties such as writing citations, handling equipment, administering medical aid, and operating radios. In time-sensitive situations, the ability to free one hand while retaining adequate lighting is a significant advantage.

Numerous solutions have been created in response to this demand. Options for hands-free lighting may include headlamps, helmet-mounted lights, or attachments that enable flashlights to be attached to uniforms or equipment. These solutions guarantee that emergency personnel have access to sufficient illumination without hindering their ability to perform their duties effectively. Modern hands-free illumination solutions are more efficient and dependable than ever before due to advances in LED technology and battery life. They provide various illumination modes, including multicolored options, to accommodate a variety of situations and needs.

In conclusion, providing emergency response personnel with options for hands-free, variegated flashlights is crucial for their safety and efficiency in low-light situations. These solutions enhance their capacity to effectively respond to emergencies, direct traffic, and complete a variety of tasks while maintaining adequate illumination. Technology advancements continue to improve these tools, ensuring that those who risk their lives have the best equipment feasible to support their vital work. The development of illuminated safety gloves fulfills this need in a method and manner that is both safe and effective.

SUMMARY OF THE DEVICE

Embodiments of the present disclosure may include a pair of illuminated safety gloves including an individual right-hand glove. Embodiments may also include an individual left-hand glove. In some embodiments, the individual right-hand glove and the individual left-hand glove may be each equipped with a palmar matrix and a dorsal matrix of colored light-emitting diodes to provide total surface illumination.

In some embodiments, the palmar matrix and the dorsal matrix of colored light-emitting diodes may be each capable of producing an independent pattern of illumination. In some embodiments, the illuminated safety gloves may include a cuff area on each of the individual right-hand glove and the individual left-hand glove. In some embodiments, the cuff area houses a charging port on a cuff exterior and an electronics enclosure on a cuff interior.

In some embodiments, the individual right-hand glove and the individual left-hand glove may be available in multiple sizes. Embodiments may also include an underlying exterior fabric of the individual right-hand glove and the individual left-hand glove may include materials, including textile, leather, or flexible plastic.

In some embodiments, the individual right-hand glove and the individual left-hand glove may be capable of independent operation and can be worn individually. In some embodiments, the illuminated safety gloves may include an inner protective fabric to separate a user's hands from a wiring harness and the dorsal matrix of colored light-emitting diodes.

In some embodiments, the individual right-hand glove and the individual left-hand glove may be each respectively programmed to display a solid color, a flashing color, an alternating color, a bright color, a dim color, a sequential color, a text, a graphic, or a chevron to indicate a desired actions or a type of directional guidance. In some embodiments, the chevron on the individual right-hand glove and the individual left-hand glove can move along a travel path to indicate a desired course of travel or a course of movement to at least one observer.

In some embodiments, the individual right-hand glove and the individual left-hand glove can be programmed for traffic control, with one surface indicating "stop" in a first color and the other surface indicating "go" in a second color. In some embodiments, the individual right-hand glove and the individual left-hand glove may be each respectively capable of displaying graphics representing a standard traffic sign, such as STOP, CAUTION, CROSSWALK, and PEDESTRIANS.

In some embodiments, the individual right-hand glove and the individual left-hand glove may be each respectively configured to indicate a hand signal for stopping, turning left, or turning right, based upon a position or a gesture of a hand within the individual right-hand glove and the individual left-hand glove. In some embodiments, the illuminated safety gloves may include a multi-axis motion sensor to detect a plurality of movements, including speed, motion, acceleration, absolute direction, and relative direction, for triggering various actions and the independent pattern of illumination.

In some embodiments, the illuminated safety gloves may include a Bluetooth™ transmitter for an initial programming by a personal electronic device via a first radio frequency (RF) wave. In some embodiments, the illuminated safety gloves may include a cellular transmitter to initiate a plurality of emergency signals in an emergency event the multi-axis motion sensor detects inactivity or specific predefined conditions of the individual right-hand glove and the individual left-hand glove.

Embodiments may also include a charging power supply charges a rechargeable battery within the individual right-hand glove and the individual left-hand glove to provide power for the palmar matrix and the dorsal matrix of colored light-emitting diodes and an individual glove associated electronic component. In some embodiments, the illuminated safety gloves may include a main controller, such as a single board computer (SBC), to process user movements detected by the multi-axis motion sensor and control the independent pattern of illumination.

In some embodiments, the inner protective fabric may be configured to create an interior space for the hands of a user. In some embodiments, the individual right-hand glove and the individual left-hand glove may be configured for various users, including law enforcement officers, motorcyclists, bicyclists, construction workers, and crane directors. In some embodiments, the individual right-hand glove and the individual left-hand glove may be configured to be customized for specific occupations and user needs, with programmed colors, actions, graphics, and hand gestures tailored to each occupation.

BRIEF DESCRIPTION OF THE DRAWINGS

The advantages and features of the present device will become better understood with reference to the following more detailed description and claims taken in conjunction with the accompanying drawings, in which like elements are identified with like symbols, and in which:

DESCRIPTIVE KEY

Figure 1:
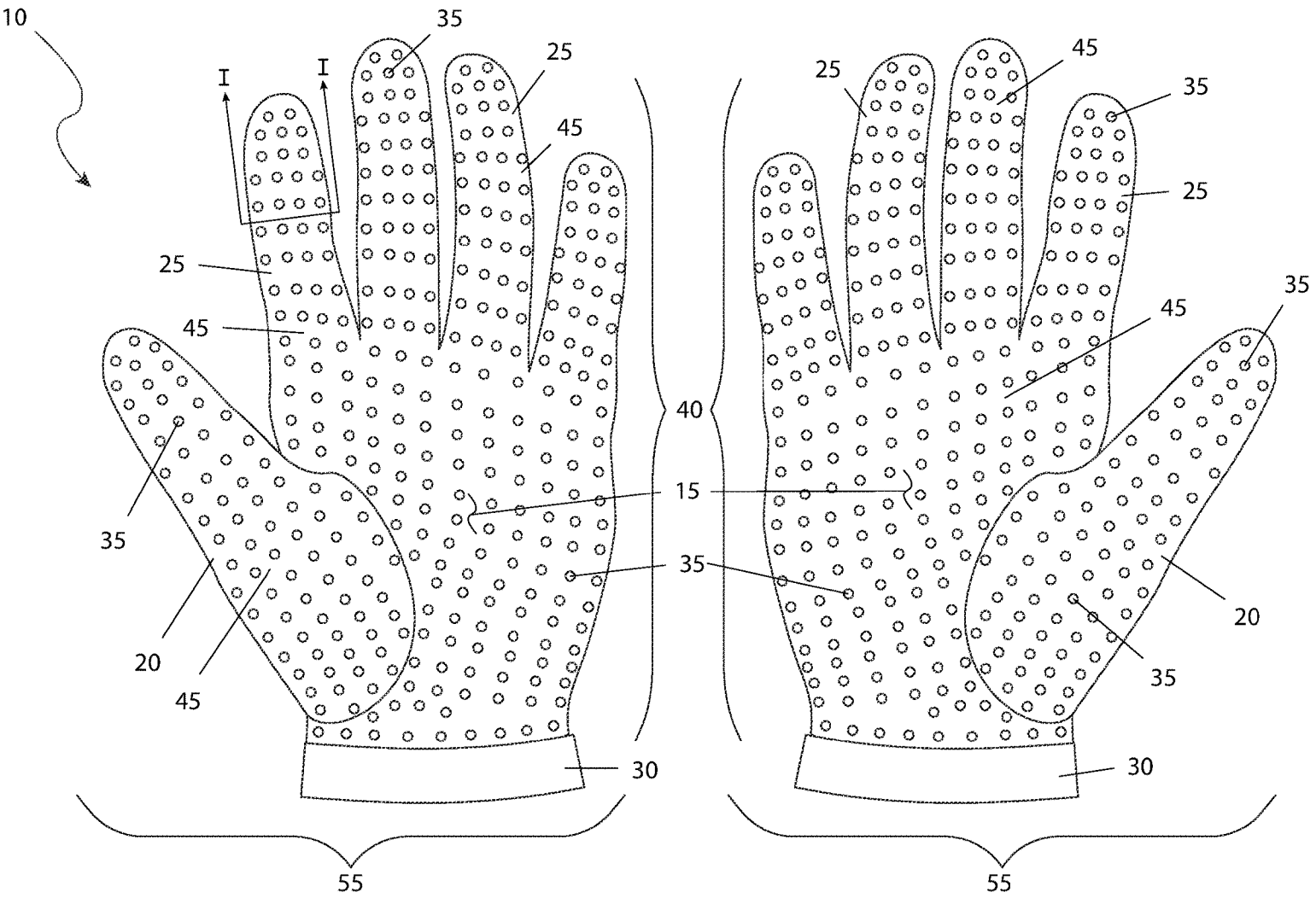
FIG. 1 is a palmar view of the illuminated safety gloves 10, according to the preferred embodiment of the present device.

10 illuminated safety glove
15 palm area
20 thumb
25 finger
30 cuff area
35 light-emitting diodes (LED's)
40 palmar matrix
45 underlying exterior fabric
50 right-hand glove
55 left-hand glove
60 dorsum area
65 dorsal matrix
70 charging port
65 electronics enclosure
80 wiring harness
85 inner protective fabric
90 interior space
92 user
95 pattern of illumination
100 chevron
195 travel path "a"
110 charging power supply
115 rechargeable battery
120 main controller
125 palmar matrix driver circuit
130 dorsal matrix driver circuit
135 multi-axis motion sensor
140 Bluetooth™ transmitter
145 personal electronic device
150 first radio frequency (RF) wave
155 cellular transmitter

DESCRIPTION OF THE PREFERRED EMBODIMENTS

The best mode for carrying out the device is presented in terms of its preferred embodiment, herein depicted within FIGS. 1 through 5. However, the device is not limited to the described embodiment, and a person skilled in the art will appreciate that many other embodiments of the device are possible without deviating from the basic concept of the device and that any such work around will also fall under scope of this device. It is envisioned that other styles and configurations of the present device can be easily incorporated into the teachings of the present device, and only one (1) particular configuration shall be shown and described for purposes of clarity and disclosure and not by way of limitation of scope. All of the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

1. DETAILED DESCRIPTION OF THE FIGURES

Referring now to FIG. 1, a palmar view of the illuminated safety gloves 10, according to the preferred embodiment of the present device is disclosed. The illuminated safety gloves 10 (herein also described as the "gloves") 10, includes an individual right-hand glove 50 and a left-hand glove 55 having total surface illumination that can produce color and even moving graphics to indicate desired guidance to others. Referring to an individual glove 10, a palmar surface depicts a palm area 15, a thumb 20, and a plurality of fingers 25 as well as a cuff area 30 as expected. The palm area 15, the thumb 20, and the fingers 25 are covered with a multitude of colored light-emitting diodes (LED's) 35, such as red-green-blue LED's 35. The LED's 35 are provided in a palmar matrix 40 to allow for separate control which will be described in greater detail herein below. It is noted that the cuff area 30 is not provided with any LED's 35. It is envisioned that the underlying exterior fabric 45 (defined as between the LED's 35) would be white in color to provide ease of observation should the LED's 35 not be illuminated, as well as a contrasting color background when the colored LED's 35 are illuminated. It is envisioned that the gloves 10 would be made in multiple sizes to fit all sizes of users 92, including adults and children.

The underlying exterior fabric 45 may be made of textile, leather, flexible plastic, or similar durable material that is suitable for the environment encountered. For example, law enforcement officers may utilize textile-based gloves 10, similar in nature to white gloves used to conventionally direct traffic, while construction workers who utilize the functionality of the gloves 10 would utilize leather-based gloves 10. As such, the use of any particular style of underlying exterior fabric 45 is not intended to be a limiting factor of the gloves 10. The gloves 10 are envisioned to consist of a right-hand glove 50 and a left-hand glove 55 and would be worn and used in pairs. However, the functionality of the gloves 10 are independent between the right-hand glove 50 and the left-hand glove 55 and may be worn and used individually as well.

Figure 2:
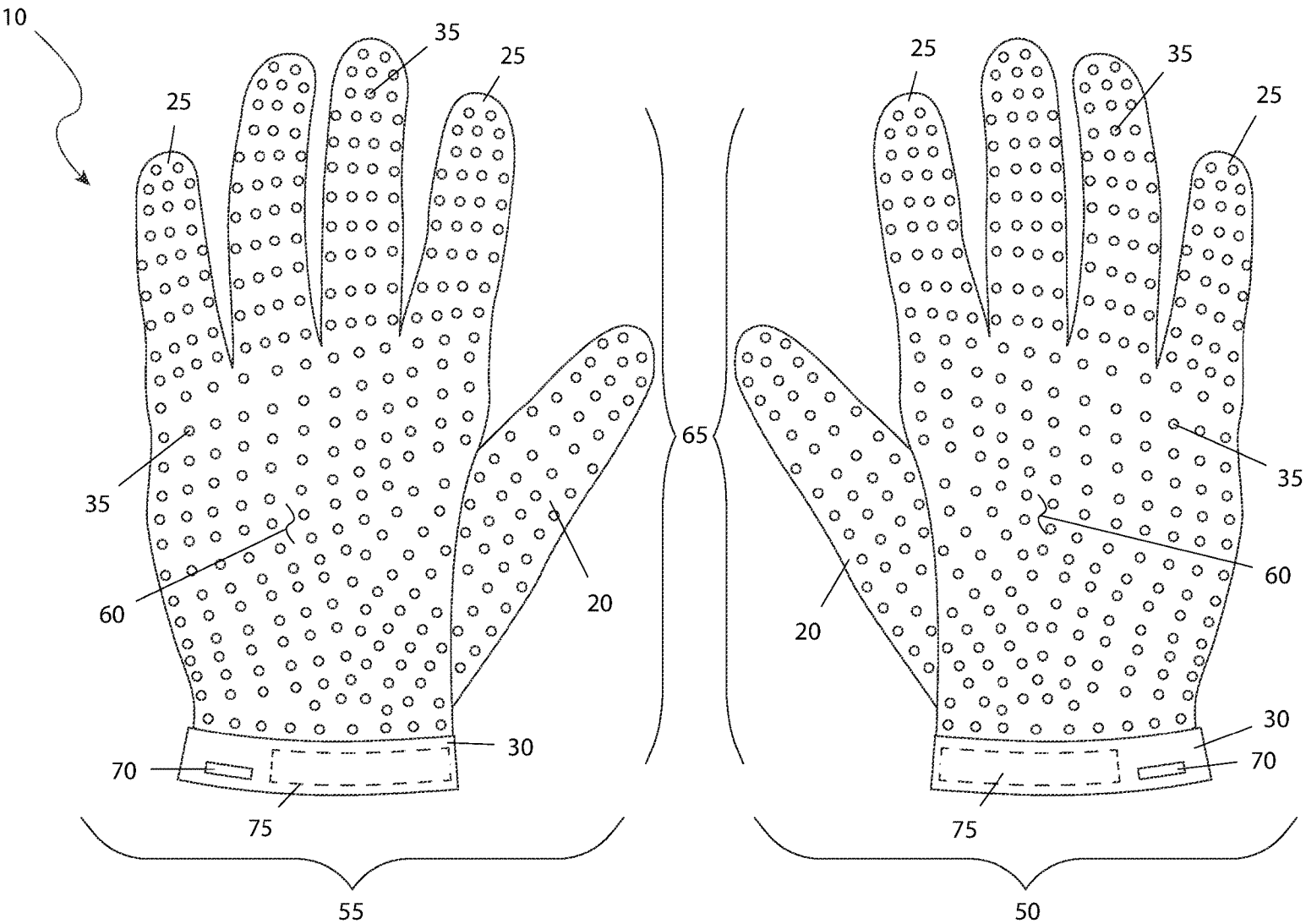
FIG. 2 is a dorsal view of the illuminated safety gloves 10, according to the preferred embodiment of the present device.

Referring next to FIG. 2, a dorsal view of the gloves 10, according to the preferred embodiment of the present device is depicted. Similar to the view of FIG. 1, a right-hand glove 50 and a left-hand glove 55 are depicted. Each glove 10 includes a dorsum area 60 as well as the thumb 20 and the fingers 25 area. The dorsum area 60, the thumb 20 and the fingers 25 are also covered with a multitude of LED's 35, all arranged in a dorsal matrix 65, to allow for separate control which will be described in greater detail herein below. Also, as before, the cuff area 30 is not provided with any LED's 35. The cuff area 30, on both the right-hand glove 50 and the left-hand glove 55 is equipped with a charging port 70 on its exterior, as well as an electronics enclosure 75, on its interior and is thus hidden from view and depicted by a dashed line to indicate its hidden nature. Further detail on the functionality of the charging port 70 and the electronics enclosure 75 will be provided herein below.

Figure 3:
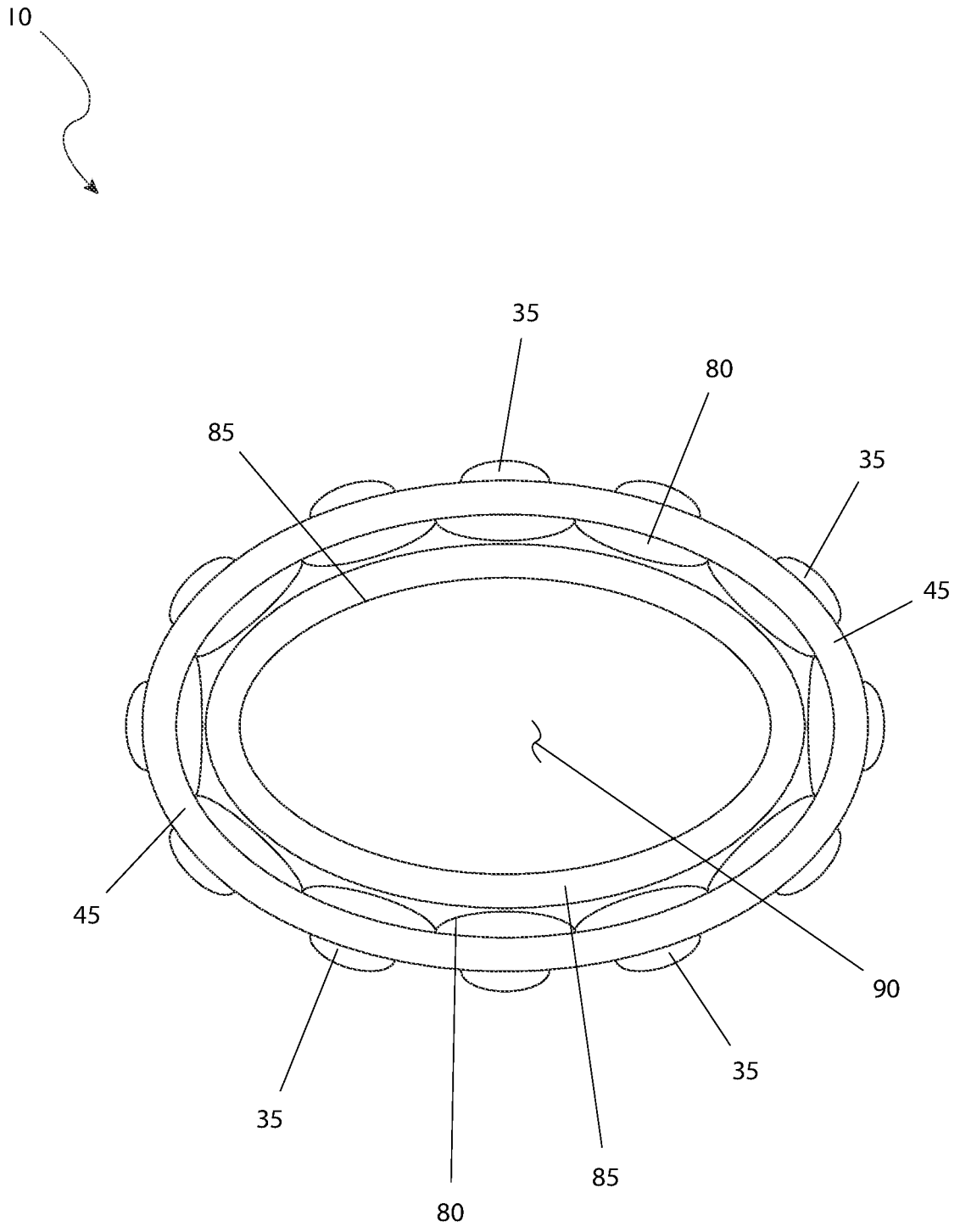
FIG. 3 is a sectional view of the illuminated safety gloves 10, as seen along a line I-I, as shown in FIG. 1, according to the preferred embodiment of the present device.

Referring now to FIG. 3, a sectional view of the gloves 10, as seen along a line I-I, as shown in FIG. 1, according to the preferred embodiment of the present device is shown. The underlying exterior fabric 45 layer is clearly visible with the individual-LED's 35 shown in a protruding nature. Each LED 35 is connected to a wiring harness 80 that allows for individual control. To prevent contact of the wiring harness 80 with the wearer's skin while the gloves 10 are being worn, an inner protective fabric 85 layer is provided. The inner protective fabric 85 is envisioned to padded and comfortable in nature and will allow for long periods of wearing while the user 92 remains comfortable. The inner protective fabric 85 produces an interior space 90 for placement of the hands of the user 92. Should sweating occur, the inner protective fabric 85 also prevents sweat moisture from contacting the wiring harness 80 and/or the LED's 35. The inner protective fabric 85 extends all through the palm area 15, the thumb 20, the fingers 25, and the dorsum area 60 (all of which are previously shown in FIGS. 1 and 2).

Figure 4:
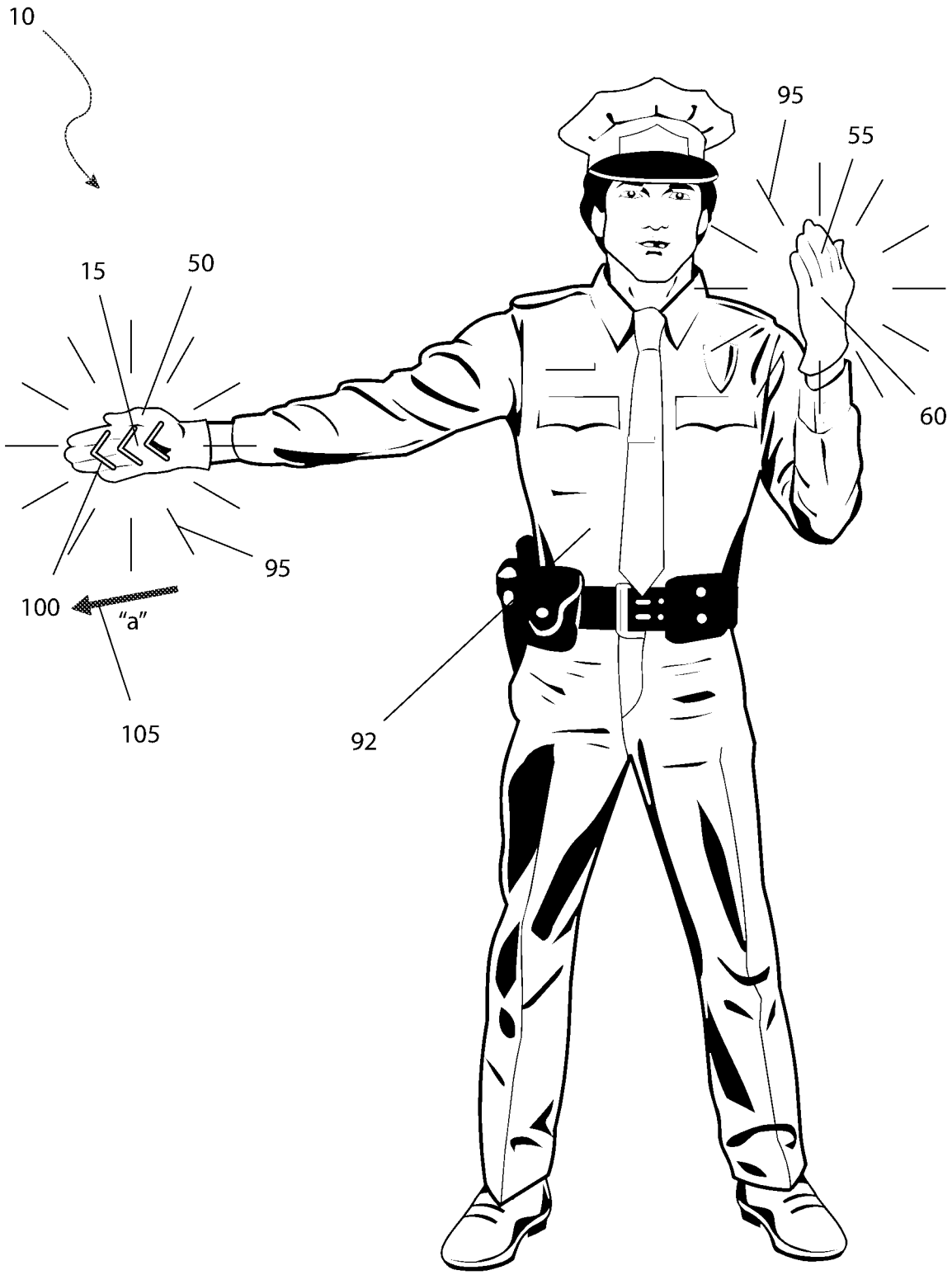
FIG. 4 is a pictorial view of the illuminated safety gloves 10, shown in a utilized state, according to the preferred embodiment of the present device; and, FIG. 5 is an electrical block diagram of the illuminated safety gloves 10, according to the preferred embodiment of the present device.

Referring next to FIG. 4, a pictorial view of the gloves 10, shown in a utilized state, according to the preferred embodiment of the present device is disclosed. The gloves 10 are shown being worn by a user 92, such as a law enforcement officer (as shown). Other possible users 92 of the gloves 10 include, but are not limited to: motorcyclists, bicyclist, construction workers, crane directors, or the like who typically utilize hand motion to indicate guidance to others. It is also envisioned that the gloves 10 can be used in matched pairs worn by different users 92, such as that with a trucker directing traffic of an oversized load, law enforcement using coordinated hand signals for aiding in communication therein between long distances. As such, the use of the gloves 10 by any particular type of user 92, using any particular style of hand motion, is not intended to be a limiting factor of the present device.

The right-hand glove 50 and the left-hand glove 55 would typically be worn on the respective hand of the user 92. This configuration would typically produce a palm area 15 (here visible on the right-hand glove 50) and a dorsum area 60 (here visible on the left-hand glove 55). Due to the independent palmar matrix 40 (as shown in FIG. 1) as well as the independent dorsal matrix 65 (as shown in FIG. 2), the gloves 10 are capable of producing independent patterns of illumination 95 dependent upon which view, the palm area 15 or the dorsum area 60, which is visible to the intended observer. The patterns of illumination 95 is envisioned as solid colors, flashing colors, alternating colors, bright colors, dim colors, sequential colors, text, graphics, or chevrons 100 as shown. The chevrons 100 may be moving along a travel path "a" 105 to indicate desired travel or movement by the observer. Other intended usage situations include the controlling of traffic at an intersection or accident scene, where one surface of the gloves 10 (either the palmar matrix 40 or the dorsal matrix 65) flashes a first color, such as red for stop, while the opposite surface (either the dorsal matrix 65 or the palmar matrix 40 respectively) flashes a second color, such as green for go, while controlling oncoming traffic. Other colors such as flashing yellow would indicate caution. It is also envisioned that the gloves 10 would be capable of displaying graphics of standard traffic signs, such as STOP, CAUTION, CROSSWALK, PEDESTRIANS and the like.

Should the gloves 10 be worn by a user 92 such as motorcyclist or bicyclist, the gloves 10 would function in the following manner: should a motorcyclist or bicyclist wish to stop, they typically indicate such action with first in the raised position. Such action would result in all LED's 35 in both the palmar matrix 40 and the dorsal matrix 65 turning a first color, such as red. The red indication can be turned off or turned to a second color, such as white, by a flick of the hand (chopping motion). A left turn would be initiated by the respective hand making a chop or a flick of the hand. This action would result in all LED's 35 in both the palmar matrix 40 and the dorsal matrix 65 turning yet another color, such as yellow, with white chevrons 100. A right turn would be indicated with their arm in an "L"-position with the hand pointing down, resulting in a similar color and indication for the respective turn.

In a similar manner, other users 92 working in other occupations such as construction workers, tow truck drivers, fire fighters, ambulance drivers and the like would utilize gloves 10 that are programmed with special colors, actions, graphics, and the like that are specific to each occupation and also be able to communicate therein between.

In all cases, the displayed colors, graphics, movement and the like as aforementioned described would be preprogrammed before use, as will be described herein below, and activated by specific movements of the user 92. This movement are envisioned to include, but not be limited to: making a fist, holding a hand up or down, thrusting a hand in a specific direction, movement of a hand in a specific pattern or the like.

Figure 5:
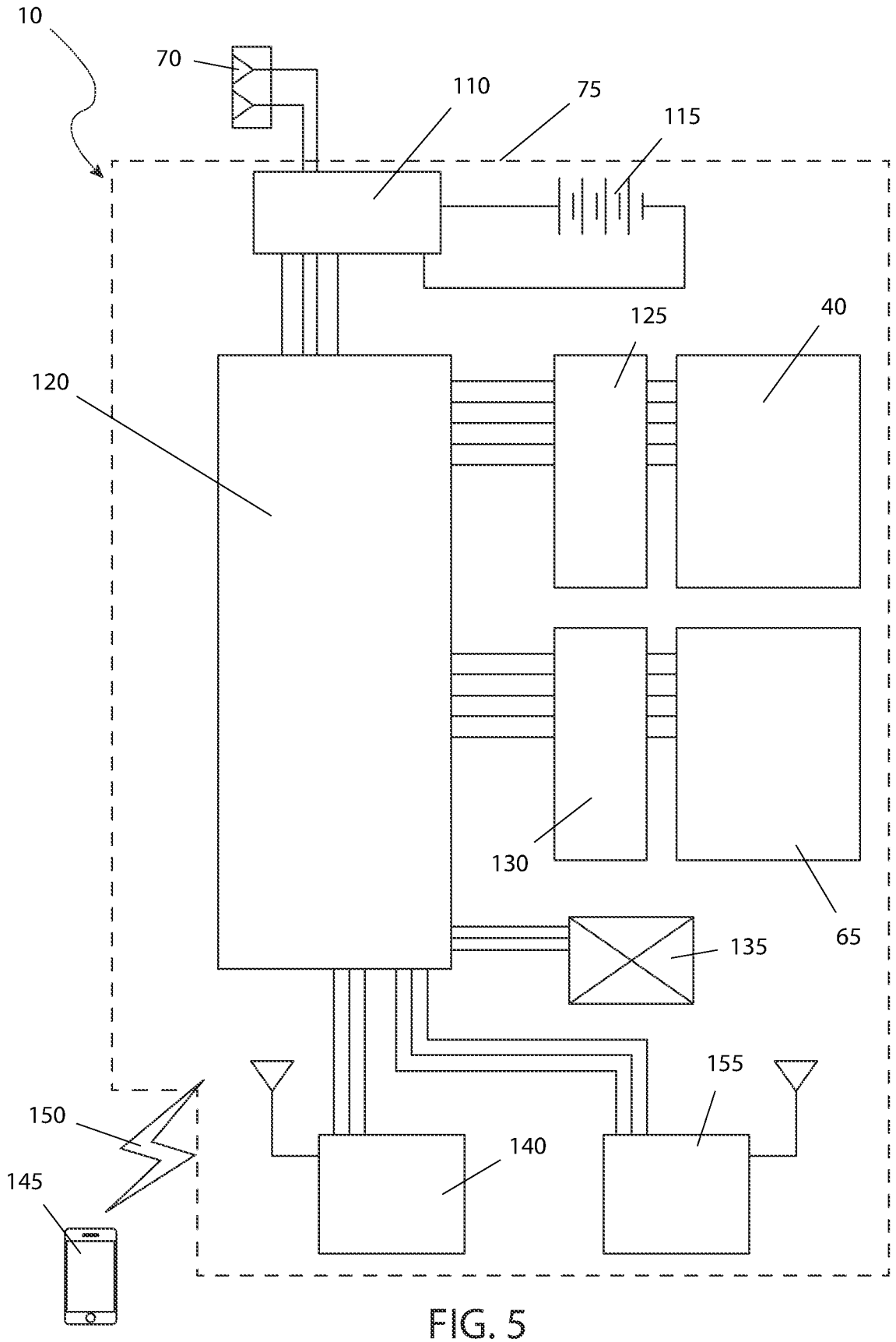

Referring to FIG. 5, an electrical block diagram of the gloves 10, according to the preferred embodiment of the present device is depicted. Charging power is derived from the charging port 70 and delivered into the electronics enclosure 75 as indicated. Resultant power is then sent to a charging power supply 110 which charges a rechargeable battery 115 and delivers constant voltage to a main controller 120, such as single board computer (SBC). The main controller 120 provides output signals to a palmar matrix driver circuit 125 and a dorsal matrix driver circuit 130 which drives the palmar matrix 40 and the dorsal matrix 65 respectively. The palmar matrix 40 and the dorsal matrix 65 contain all of the LED's 35 (as shown in FIGS. 1 and 2), as aforementioned described. A multi-axis motion sensor 135 provides all input to the main controller 120, for activating various modes of the gloves 10, by specific various movements of the user 92 (as shown in FIG. 4) while wearing the gloves 10. Speed, motion, acceleration, absolute direction, relative direction, and the like, may also be detected by the multi-axis motion sensor 135, in an effort to trigger various actions, dependent on the usage, occupation, and the like. Additional input/output functionality is afforded by a Bluetooth™ transmitter 140, which allows for initial programming by a personal electronic device 145 via a first radio frequency (RF) wave 150. The personal electronic device 145 would be running a dedicated application. Specific colors, patterns, graphics, along with the initiating motions, as detected by the multi-axis motion sensor 135 would be programmed into the main controller 120. Finally, a cellular transmitter 155 would allow the main controller 120 to initiate an emergency signal, such as a 911 call, in the event of the user 92 (as shown in FIG. 4) collapsing, not moving, or the like, as detected by the multi-axis motion sensor 135.

2. OPERATION OF THE PREFERRED EMBODIMENT

The preferred embodiment of the present device can be utilized by the common user 92 in a simple and effortless manner with little or no training. It is envisioned that the gloves 10 would be constructed in general accordance with FIG. 1 through FIG. 5. The user 92 would procure the gloves 10 from conventional procurement channels such as law enforcement supply stores, emergency equipment retailers, mail order and internet supply houses and the like. Special attention would be paid to the overall size of the gloves 10.

After procurement and prior to utilization, the gloves 10, either comprising a right-hand glove 50, the a left-hand glove 55, or both, would be initially charged by applying an appropriate voltage to the charging port 70. The display of the palmar matrix 40 and the dorsal matrix 65, as well as the actions of resultant motion as detected by the multi-axis motion sensor 135, would be initially programmed by the personal electronic device 145 through the Bluetooth™ transmitter 140. At this point in time, the gloves 10 are ready for use.

During utilization of the gloves 10, the right-hand glove 50 and/or the left-hand glove 55 would be worn by the user 92. Various motions such as movement, rotation, thrusts, acceleration, and the like, would be detected by the multi-axis motion sensor 135. These signals would be used by the main controller 120 to direct various patterns of illumination 95 on both the palmar matrix 40 and/or the dorsal matrix 65 as required. Resultant patterns of illumination 95 would serve to guide observers resulting in increased reaction time and enhanced safety.

After use the gloves 10 are removed and stored until needed again in a repeating and cyclical manner.

The foregoing descriptions of specific embodiments of the present device have been presented for purposes of illustration and description. They are not intended to be exhaustive or to limit the device to the precise forms disclosed, and obviously many modifications and variations are possible in light of the above teaching. The embodiments were chosen and described in order to best explain the principles of the device and its practical application, to thereby enable others skilled in the art to best utilize the device and various embodiments with various modifications as are suited to the particular use contemplated.

What is claimed is:

1. A pair of illuminated safety gloves comprising:

an individual right-hand glove;

an individual left-hand glove;

a cuff area on each of the individual right-hand glove and the individual left-hand glove;

an inner protective fabric to separate a user's hands from a wiring harness and the dorsal matrix of colored light-emitting diodes;

a wireless transmitter for an initial programming by a personal electronic device via a first radio frequency (RF) wave; and, a cellular transmitter to initiate a plurality of emergency signals in an emergency event the multi-axis motion sensor detects inactivity or specific predefined conditions of the individual right-hand glove and the individual left-hand glove; and, wherein the individual right-hand glove and the individual left-hand glove are each equipped with a palmar matrix and a dorsal matrix of colored light-emitting diodes to provide illumination;

wherein the cuff area houses a charging port on a cuff exterior and an electronics enclosure on a cuff interior;

wherein the chevron on the individual right-hand glove and the individual left-hand glove is configured to illuminate in a manner that gives an appearance of movement along a travel path to indicate a desired course of travel or a course of movement to at least one observer; and, wherein the inner protective fabric is configured to create an interior space for a hand of a user.

2. The illuminated safety gloves of claim 1, wherein the palmar matrix and the dorsal matrix of colored light-emitting diodes are each capable of producing an independent pattern of illumination.

3. The illuminated safety gloves of claim 1, wherein an underlying exterior fabric of the individual right-hand glove and the individual left-hand glove comprises materials, including textile, leather, or flexible plastic.

4. The illuminated safety gloves of claim 1, wherein the individual right-hand glove and the individual left-hand glove are capable of independent operation is wearable individually.

5. The illuminated safety gloves of claim 1, wherein the individual right-hand glove and the individual left-hand glove are each respectively programmed to display a solid color, a flashing color, an alternating color, a sequential color, a text, a graphic, or a chevron to indicate a desired actions or a type of directional guidance.

6. The illuminated safety gloves of claim 1, wherein the individual right-hand glove and the individual left-hand glove can be programmed for traffic control, with one surface indicating "stop" in a first color and the other surface indicating "go" in a second color.

7. The illuminated safety gloves of claim 1, wherein the individual right-hand glove and the individual left-hand glove are each respectively capable of displaying graphics representing a standard traffic sign, being STOP, CAUTION, CROSSWALK, and PEDESTRIANS.

8. The illuminated safety gloves of claim 1, wherein the individual right-hand glove and the individual left-hand glove are each respectively configured to indicate a hand signal for stopping, turning left, or turning right, based upon a position or a gesture of a hand within the individual right-hand glove and the individual left-hand glove.

9. The illuminated safety gloves of claim 1, further comprising a multi-axis motion sensor to detect a plurality of movements, including speed, motion, acceleration, absolute direction, and relative direction, for triggering various actions and an independent pattern of illumination.

10. The illuminated safety gloves of claim 1, further comprising a main controller, being a single board computer (SBC), to process user movements detected by the multi-axis motion sensor and control the independent pattern of illumination.

11. The illuminated safety gloves of claim 1, wherein a charging power supply charges a rechargeable battery within the individual right-hand glove and the individual left-hand glove to provide power for the palmar matrix and the dorsal matrix of colored light-emitting diodes and an individual glove associated electronic component.

* * * * *